US008691345B2

(12) United States Patent
Wang

(10) Patent No.: US 8,691,345 B2
(45) Date of Patent: Apr. 8, 2014

(54) APPARATUS AND METHOD FOR PRINTING IN BOTH IMAGE AND AROMA DOMAINS INTELLIGENTLY

(75) Inventor: Shen Wang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 694 days.

(21) Appl. No.: 12/946,260

(22) Filed: Nov. 15, 2010

(65) Prior Publication Data

US 2012/0121813 A1 May 17, 2012

(51) Int. Cl.
*B05D 1/00* (2006.01)
*B41J 29/38* (2006.01)

(52) U.S. Cl.
USPC ..... 427/401; 347/9

(58) Field of Classification Search
USPC ..... 347/9, 20
See application file for complete search history.

(56) References Cited

U.S. PATENT DOCUMENTS

| | | | | |
|---|---|---|---|---|
| 5,975,675 | A | 11/1999 | Kim | |
| 5,995,770 | A | 11/1999 | Rochford | |
| 6,164,747 | A * | 12/2000 | Yashima et al. | 347/15 |
| 6,261,347 | B1 * | 7/2001 | Moreland | 106/31.02 |
| 7,324,693 | B2 | 1/2008 | Chen | |
| 7,795,327 | B2 | 9/2010 | Mizushima et al. | |
| 2003/0137550 | A1 * | 7/2003 | Baiges | 347/20 |

* cited by examiner

*Primary Examiner* — Lisa M Solomon
(74) *Attorney, Agent, or Firm* — Eugene I. Shkurko; Amit Singhal

(57) ABSTRACT

A method comprising an algorithm for automatically detecting an object in a digital image in order to determine if a scent can be associated with the detected object and applying the scent to the print medium, and a printer equipped to apply the scent.

11 Claims, 7 Drawing Sheets

APPARATUS AND METHOD FOR PRINTING IN BOTH IMAGE AND AROMA DOMAINS INTELLIGENTLY

FIELD OF THE INVENTION

The present invention relates generally to printer technology, and more particularly to printing scented images.

BACKGROUND OF THE INVENTION

Traditional printer technology prints images in an image domain, either color or monochrome. In addition, prior art methods include effects applied to paper to make images on paper more interesting. For example, some images are embossed so that people can touch and feel them, which might be referred to as the tactile domain. Some images have buttons behind them so that a music or a song will play if the buttons are activated, which may be referred to as the auditory domain. Some images will have perfume smell such as a cosmetic catalog to attract consumers, which we refer to herein as the aroma domain. U.S. Pat. No. 5,975,675 describes a printer that can spray perfume onto paper in addition to printing text characters and images. As described in U.S. Pat. No. 5,975,675 the type of perfume is pre-selected or user-input. The disclosure of this patent is incorporated herein by reference in its entirety.

Another U.S. Pat. No. 5,995,770, describes a system to allow a user to pre-select an applicable scent which is to be applied to an image. Then at the photofinishing site the scent can be delivered to a print, or a set of prints along with an image. The disclosure of this patent is incorporated by reference herein in its entirety.

A limitation common to these prior art patents is that the scent is pre-selected and the region of the print where the scent is applied is pre-determined as well. The technology that the prior art describes is useful for mass printing of identical brochures or catalogs for advertising.

Therefore, there is a need to design a printing technology which will intelligently detect the image content and will print either the image alone or the image together with a selected scent applied to the image receiver.

SUMMARY OF THE INVENTION

A preferred embodiment of the present invention includes a method comprising automatically detecting an object in a digital image in order to determine if a scent can be associated with the detected object. Various detection algorithms are known that can identify objects in digital images. A printer automatically identifies one of a plurality of scents corresponding to the detected object which is stored in the printer and is applied to an image receiver or print medium. Although the scented fluid can be applied on the printed portion of the image, it is preferable to apply the scented fluid in a margin of the printed receiver or in another portion of the print medium where the image data is not printed. This includes a reverse side of the receiver sheet opposite the printed side. The applied scent corresponds to the detected object. The present invention should not be construed to limit the application of a scent only in a margin or unprinted portions of a print medium. For example, a flower detected in an image can trigger an application of a scent associated with that flower. Detected objects that are typically associated with a holiday can trigger an application of a scent associated with the holiday. A location in the print of the object is determined and a region is selected on the media whereupon to apply a scent, which can include applying the scented fluid on top of the printed object. The selected region can also include any white space on the media or any unprinted space on the media.

Another preferred embodiment of the present invention includes a printer comprising ink reservoirs and a print head for printing text characters and images on a print medium. The printer includes a plurality of scented fluid reservoirs and a plurality of nozzles or spray heads, or atomizers, in communication with the scent reservoirs for applying at least one of the scented fluids onto the print medium. The spray nozzles are controllable for applying the scented fluids onto the print medium. Each of the spray nozzles are controllable for applying the scented fluids onto a different region of the print medium by moving a carriage, which holds the scented fluid reservoirs, back and forth in concert with moving the print medium forward or backward through the printer.

These, and other, aspects and objects of the present invention will be better appreciated and understood when considered in conjunction with the following description and the accompanying drawings. It should be understood, however, that the following description. while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

Embodiments of the invention are better understood with reference to the following drawings. The elements of the drawings are not necessarily to scale relative to each other.

DETAILED DESCRIPTION OF THE INVENTION

Figure 1:
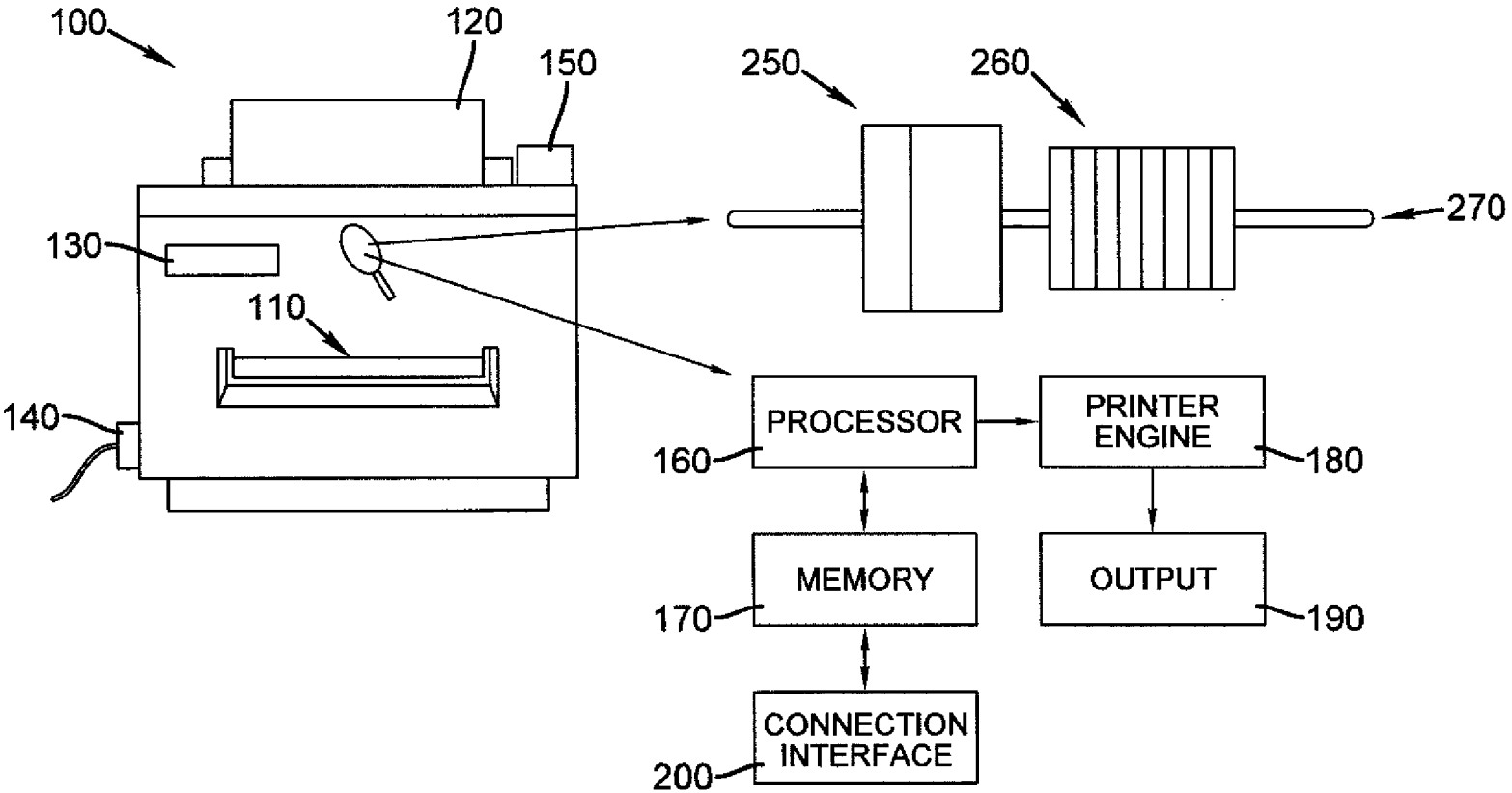
FIG. 1 is a diagram of a printer in accordance with the invention.

FIG. 1 is a diagram of a printer in an embodiment in accordance with the present invention. Printer 100 consists of a print medium loading cartridge 110, an output medium tray 120, an input bay 130 for a multimedia card reader, a connection port section 140 for networking and a panel control 150. The panel control 150 can be configured with function buttons like "start", "stop", "reset" or "resume", etc; or it can be a touch screen display which allows a user to control the printer 100 by touching the screen regions associated with specific functions. The printer comprises a processor 160 for image processing and for controlling the printer engine. A memory 170 inside the printer 100 is used to load and buffer images and to store printer programs for processing images. The printer engine 180 includes ink cartridge 250 and scent cartridge 260 seated on a carriage bar 270 which operates in a standard fashion but for the addition of the scent cartridge and control of the movements of the scent cartridge for applying scented fluids from the scent cartridges. The scent cartridge 260 includes at least one or more scent reservoirs (not shown) which each hold at least one or more scented fluids and are coupled to the scent print head in a manner equivalent to the coupling of the ink cartridges to the ink print head. The printer 100 also includes a mechanism to transport the print medium in a standard manner, and electronics to control the printer's operation (not shown). A connection interface 200 includes circuitry for communication between various drives 130 and the network connection 140. An output 190 of the printer includes the output media tray 120.

It is understood that the actual physical design of the printer can be flexible. For example, the ink cartridge 250 and scent reservoir 260 can be situated on separate carriage bars.

Figure 2:
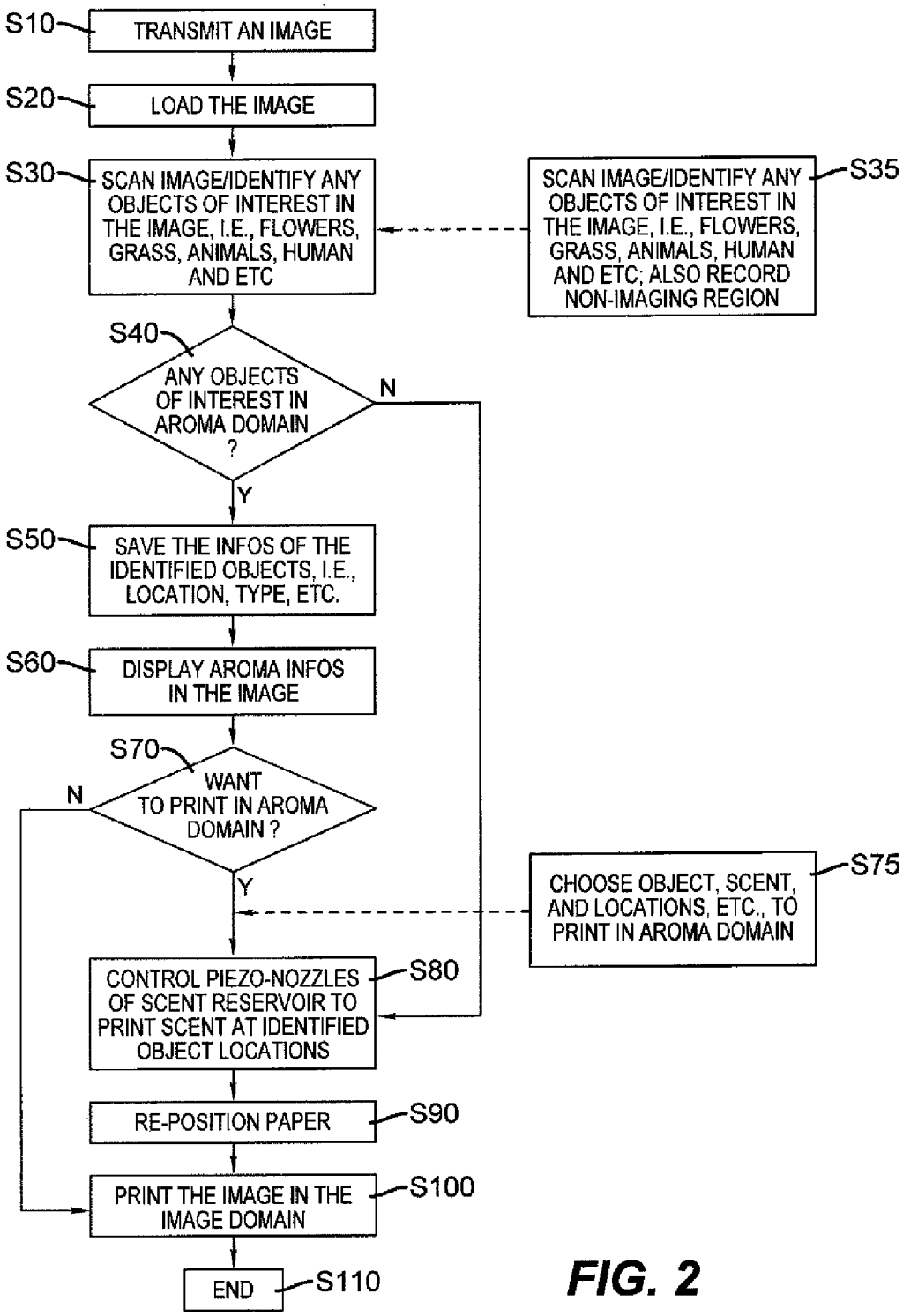
FIG. 2 is a block diagram of the printing process in accordance with the invention.

FIG. 2 illustrates a flowchart of the printer operation in accordance with the present invention. A user sends an image to the printer 100 either by networking cable 140, wirelessly, or by inserting a disk, flash drive, or any other storage medium which provides the image in the input bay 130 (step S10). The printer 100 loads the image in its buffer memory 170 (step S20). The processor 160 in the printer 100 analyzes the image. Object recognition algorithms detect the existence of any object of interest in the image which might correspond to an object for which a scent can be applied to the print medium, such as flowers, animals, human, etc. (step S30). For example, U.S. Pat. No. 7,324,693 teaches an algorithm to detect a human figure in images automatically and reliably, the disclosure of which is incorporated by reference herein in its entirety. The algorithm first searches characteristic features such as human eyes in an image, computes the locations of the found features, determines the boundary parameters of the characteristic features like the human body, computes a set of the indicative pixel values for a contour of the boundary, and finally automatically outlines the contour of the characteristic features like the human body.

Methods of detecting other objects like flowers are also described in the prior art. One example is "An automatic visual Flora—segmentation and classification of flower images" by Maria-Elena Nilsback, Robotics Research Group, Department of Engineering Science, University of Oxford, PhD Thesis, 2009, which describes methods to automatically recognize and classify different flowers in relatively reliable way. The object recognition algorithm is implemented in a form of a computer program loaded and saved in the printer memory 170. The object recognition algorithm identifies any objects of interest detected in the image (step S40) for which a scent is associated. If such an object is detected, the printer, under control of the program stored in the printer memory, generates information about the objects such as the type of object, location coordinates in the image relative to the image size, and the associated scent (step S50). This detection algorithm can be simply incorporated in a non-preferred embodiment as a binary step of detecting whether an image of a flower exists in the digital image and, if so, applying a single scent to the image, wherein the scent fluid reservoir contains only the single scented fluid or perfume. Next the printer touch screen 150 displays the information related to the image including the objects which can be printed in the aroma domain (block S60). The printer can automatically apply a scent or request the user to select print scents for the detected objects through a pop-up window (step S70). For example, the printer analyzes an image and detects a flower. It displays the location of the flower, type of scent, etc. It asks the user for confirmation to print the scent. The user can either accept or reject the scent print. This option can prevent unwanted scented prints.

Optional preferred embodiments illustrated in the flowchart of FIG. 2 include a printer with no user interaction (skip step S70) or with more user interaction by letting users choose different scents, onto different objects, at different locations (step S75 can be inserted in the process flow for this optional preferred embodiment). Another option can include the user can choose a light or a heavy scent print. The heavy scent will last longer than the light scent. One way to implement the heavy scent print or greater intensity of scent is simply to apply scent at the same location twice so that more scent fluid is deposited on the print medium. Another way is to implement different sizes of the scent nozzles for each scent reservoir in the scent print head. These types of differential sized nozzles are used in print heads for current ink jet printers. In a scent print head utilizing differential sized nozzles, the heavy scent print can use the large size of the nozzle and the light scent print can use the small size of the nozzle because the larger sized nozzles deliver more scented fluid than the smaller sized ones. It is also understood that more than two levels of intensity of scent can be designed as well.

The printer 100 then controls the printer engine 180 to move the print medium to the right location and starts to print scent by controlling the print head of the scent reservoir 260 in the locations where the objects are located relative to the image (step S80) and starts to print the scent in the selected locations. When the printer finishes the scent print, it rolls back the print medium to the exact start position as before (step S90). The final step is to print the image in the normal course using the standard ink cartridge 260 (step S100) and the process is finished (block S110). The user can bypass the scent printing (step S70) so the printer just jumps directly to the block S100 to print the image in the image domain. If there are no objects detected corresponding to scented fluids in the printer, the printer prints the image directly as a normal printer does by jumping from step S40 to step S100 directly, and completes the printing process (step S110).

Figure 5:
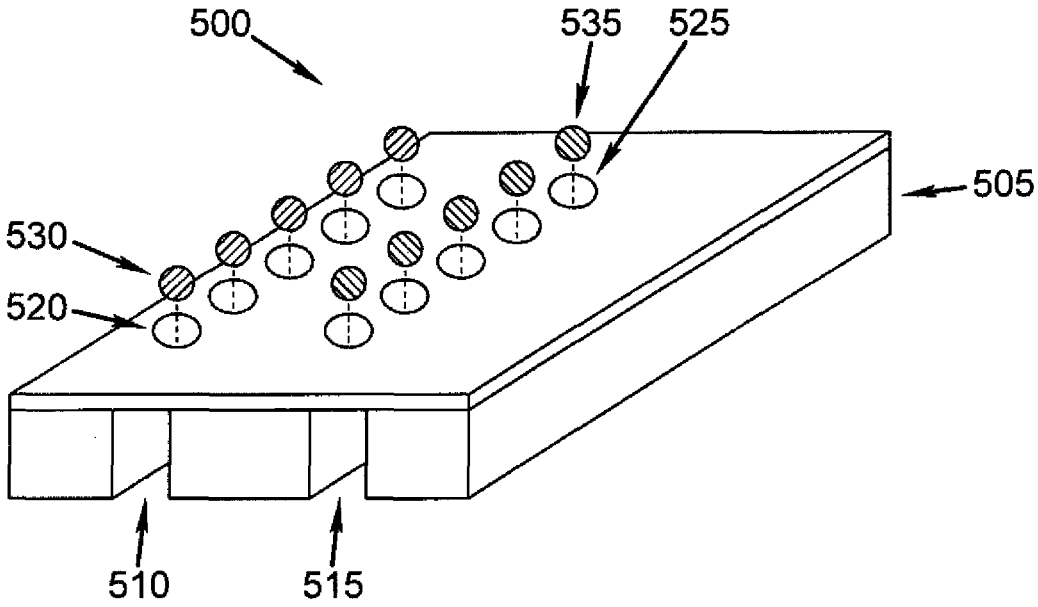
FIG. 5 is a diagram of a scent print head with nozzles in accordance to the invention.

FIG. 5 shows a scent print head 500 which can eject scent in accordance with the present preferred embodiment of the invention. The print head 500 is built on a die substrate 505. Separate pathways 510 and 515 transfer the scent liquids to the arrays of print nozzles 520 and 525. Two scent liquid reservoirs (not shown) are connected to the pathways to supply the scent liquids. Although two scent sources are shown in FIG. 5, it is understood that a single scent source or more than two scent sources can be configured in the print head 500. A droplet of a first scent fluid 530 is ejected from the nozzle 520 and a droplet of a second scent fluid 535 is ejected from the nozzle 525. The ejection is controlled, as in the normal course of a non-scented printer by electronics in the print head 500 controlled by the printer processor 160.

The print head can include a piezoelectric transducer to compress the volume of a scented fluid causing scent fluid ejection. Or the print head can include a heating element to vaporize a portion of the scent fluid and therefore cause ejection, both of which are commonly used in inkjet printers.

Figure 7:
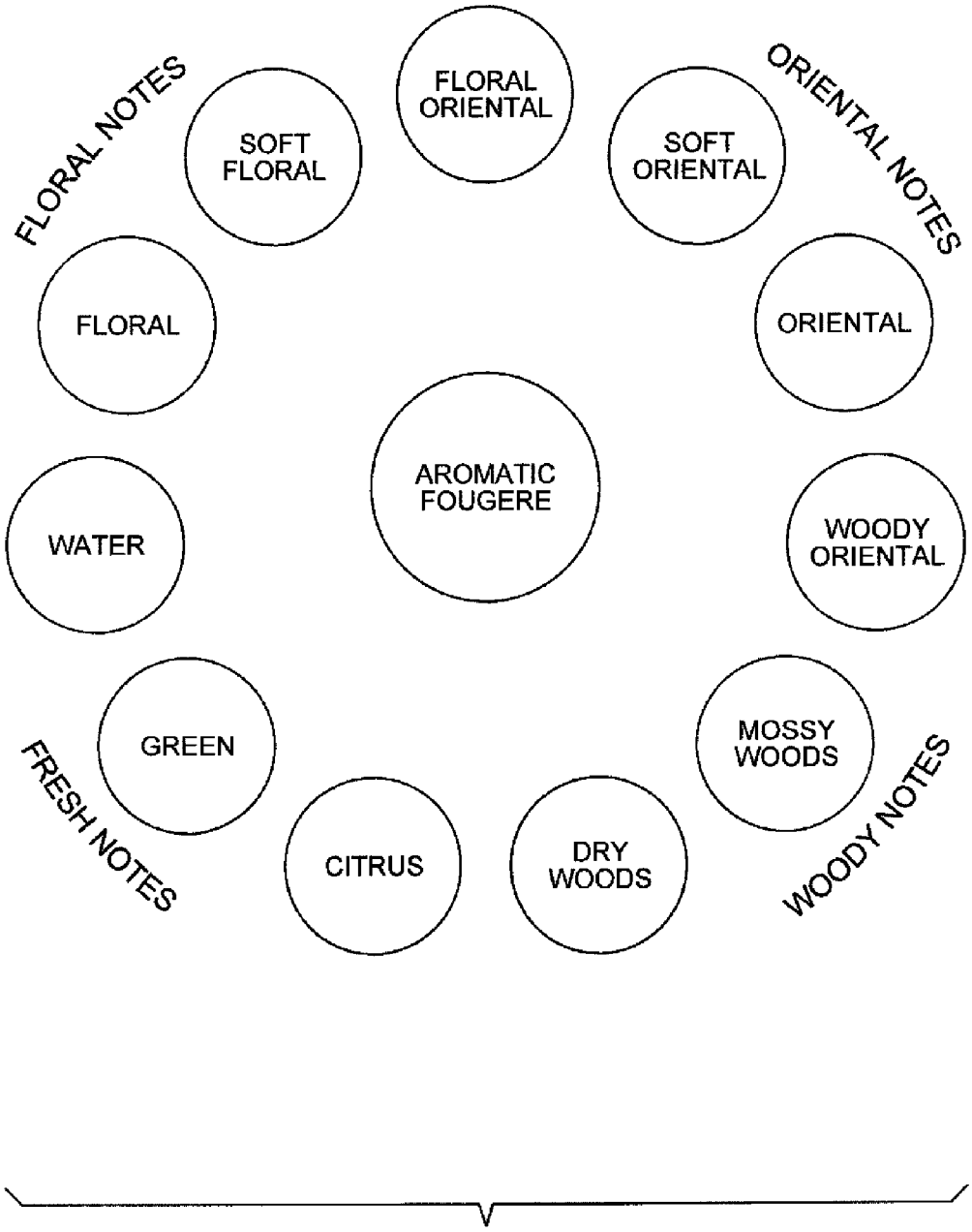
FIG. 7 illustrates a fragrance wheel.

Much work has been done to classify the scent, especially the "good" scent or appealing scent like fragrance. For example, M. Edwards in 1983 developed a so-called "Fragrance Wheel" shown in FIG. 7 to classify different fragrance. Five different fragrance types can be characterized as Floral, Oriental, Woody, Fougère, and Fresh, with the former four families being more "classic" while the last one consists of newer bright and clean smelling citrus and oceanic fragrances that have been developed due to improvements in fragrance technology. The fragrances can be manufactured using natural ingredients such as flower or plant extracts, or by synthetic chemical compounds. Preferably, the printer 100 will print appealing or attractive scents like fragrance or perfume onto an image. However, it is understood that any kind of scent including non-appealing ones can be applied to the image if desired.

Figure 3:
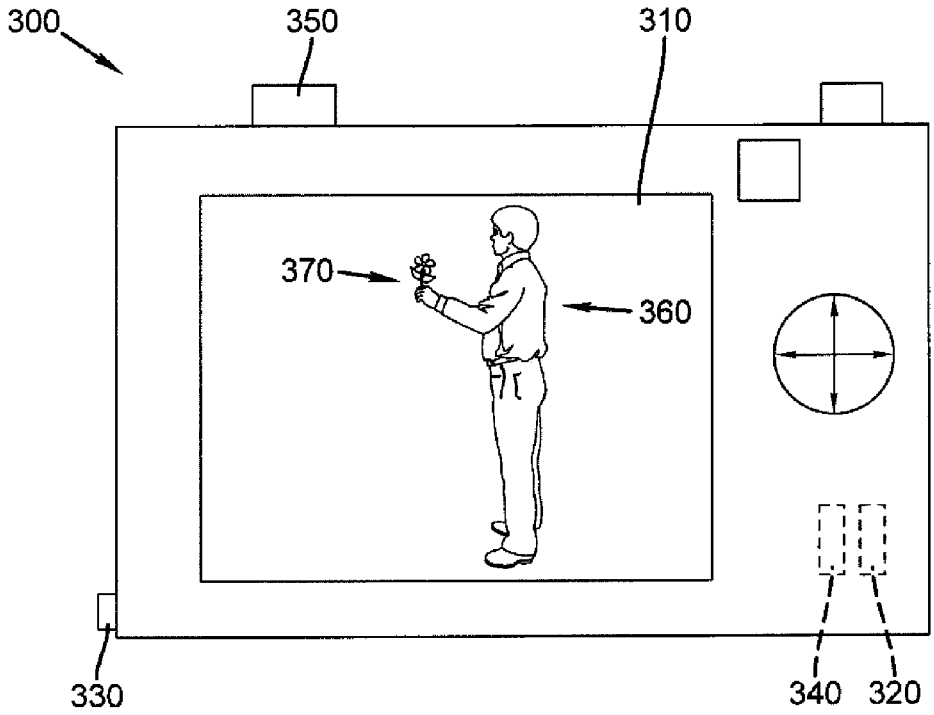
FIG. 3 is a diagram of a camera showing an image with a person holding a flower.

FIG. 3 shows an example of an image 310 displayed in a digital camera 300. The camera has a SD card 320, USB port 330 and a wireless card 340 to connect to a network which includes printer 100 in accordance with the present invention. Inside the camera 300, an image 310 is saved in a SD card 320. The image 310 shows a person 360 holding a flower 370. The image can be transferred to the printer either by the SD card 320 or a USB connection 330. Or the user can transmit the image to the designated printer 100 wirelessly through wireless interface 340. An input such as a touch screen, button, or voice activation can be implemented to allow a user to control this step. The user then sends the image 310 to the printer 100 either by wireless transmission, or by the SD card.

Figure 4:
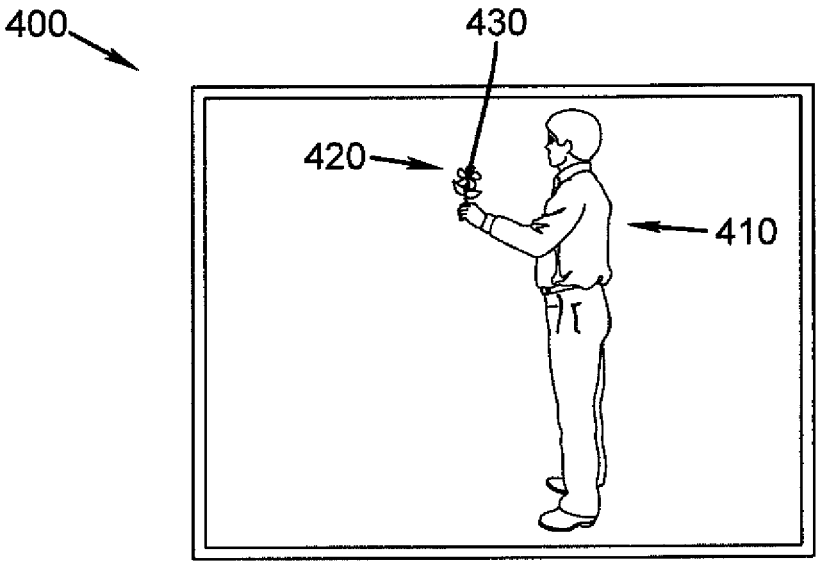
FIG. 4 is a print of the image from the printer in accordance with the invention.

FIG. 4 shows the print 400 of the image 310 from the camera as output from the printer. In the print 400, there is a person 410 holding a flower 420. In addition to the visual effect of the picture, the printer also prints a flower scent in the center of the flower 430 so that it has an appealing effect. Although one scent, i.e., of a flower, is shown in FIG. 4, it is understood a printer comprising multiple scent reservoirs can store scent fluids from different flowers if the object detection algorithm is able to recognize different kinds of flowers. It is also understood that a printer can not only print scent of flowers, but also other scents from other objects such as trees, oceans, etc., based on the printer's configuration. Alternative preferred embodiments also include applying a scent right at an object's location on a print; printing in a non-imaging region, and printing on a back of the print medium. For example, if a printer is dedicated to print only scent of nature such as flowers, its detection algorithm should be able to detect these objects reasonably reliably and the printer should include the scent fluid reservoirs for these objects. In addition, a printer can be configured to print any combination of scents if necessary as long as the technique of detection algorithm and the scent fluid is available.

It is also understood that the scent location in FIG. 4 is not limited to one location. In a preferred embodiment of the present invention, the scent is printed right at the center of the related object. In this case, the center of the flower 430 is the preferred scent print location if the scent fluid does not react with the ink. This is true for a printer that uses pigment based ink. For example, U.S. Pat. No. 7,795,327 discloses water dispersions containing pigment-containing water-insoluble vinyl polymer particles and water-based inks containing the water dispersions. If the scent fluid reacts with the ink, the printer needs to print the scent in either a non-imaging region in the print, such as in a blank space or in a margin of the print medium, or on the back of the print medium.

In the case of printing scent in a non-imaging region, the detection algorithm can record the region without any imaging content after performing the detecting step (step S35 to replace step S30 in FIG. 2 for this optional embodiment). The region without any imaging contents is easy to detect. For a normal image, the pixel intensity of a non-imaging region is zero or substantially zero. Therefore, a block of pixels with zero or substantially zero intensity indicates a non-imaging region.

Figure 6:
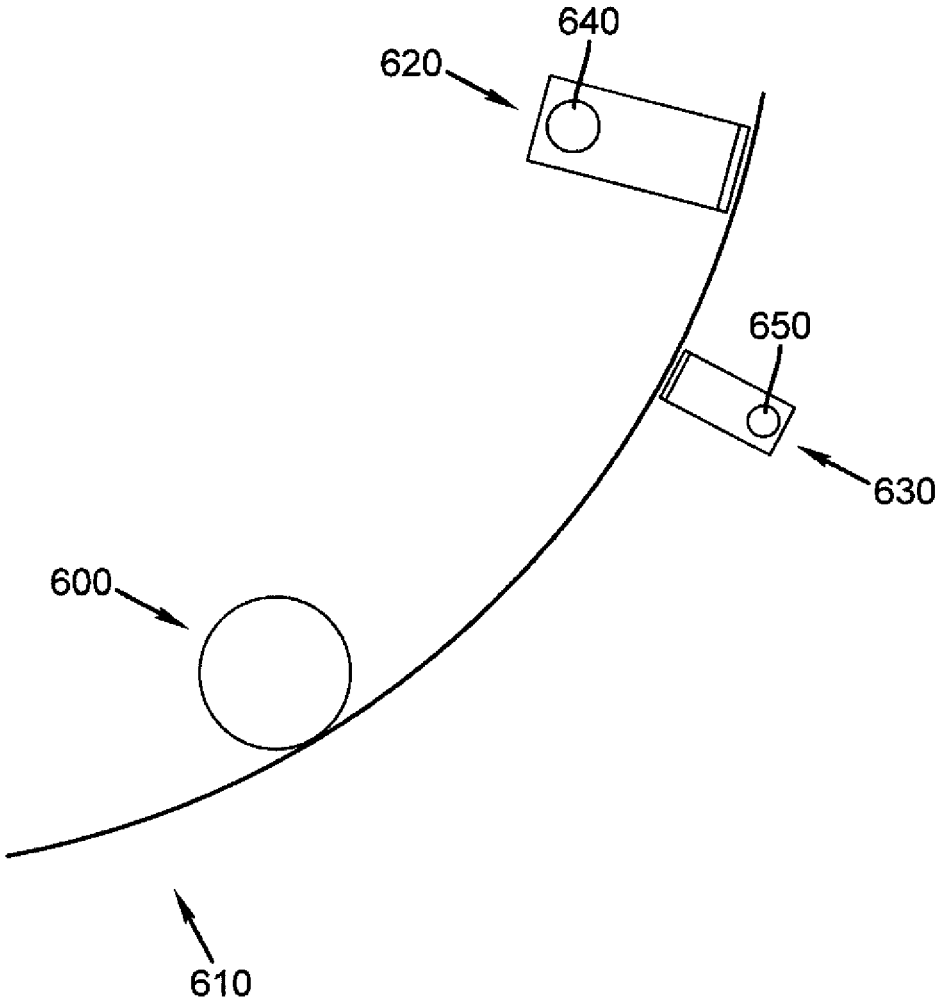
FIG. 6 is a diagram of locations of the ink and scent print heads along with the print medium path inside a printer in accordance to another embodiment of the invention.

In the case of print scent on the back of a print, the printer 100 needs to be modified. Instead of having the ink print head and scent print head on the same carriage rail, the scent print head is located on the opposite side of the print medium. FIG. 6 shows a portion of the section inside the printer 100 which includes a print medium roller 600 to transfer the print medium 610 through the printer. An ink print head 620 is located on one side of the medium while the scent print head 630 is located on the other side of the medium. The ink reservoir through-hole 640 is to mount the ink print head 620 in front of the print medium and to allow the ink print head 620 to move across the print medium from the front side. In the meantime, the scent reservoir through-hole 650 is to mount the scent print head 630 on the back of the print medium and to allow the scent print head to move across the print medium from the back side. Alternatively, a scent applicator or scent print head can be mounted in a stationary position for backside printing, and so can be equipped with a simple spray atomizer for applying scented fluids or perfumes to a back side of a print medium. This configuration will allow the printer to print image on one side and the scent on the other side of the print medium. The rest of the printer design can be identical to the printer 100 described above.

The invention has been described in detail with particular reference to certain preferred embodiments thereof, but it will be understood that variations and modifications can be effected within the spirit and scope of the invention. For example, the embodiments described herein the sequence of process flow to print can be changed in terms of the order of printing in image domain or in aroma domain.

PARTS LIST

100 printer
110 print medium loading cartridge
120 output medium tray
130 an input bay
140 connection port
150 panel control
160 processor
170 memory
180 printer engine
190 output
200 connection interface
250 ink cartridge
260 scent cartridge
270 cartridge bar
S10 step
S20 step
S30 step
S35 step
S40 step
S50 step
S60 step
S70 step
S75 step
S80 step
S90 step
S100 step
300 digital camera
310 image inside the camera
320 SD card
330 USB port
340 wireless card

350 button
360 a person in the image
370 a flower in the image
400 a print with the image
410 a person in the print
420 a flower in the print
430 the center of the flower
500 scent print head
505 die substrate
510 pathway
515 pathway
520 print nozzle
525 print nozzle
530 scent liquid
535 scent liquid
600 print medium roller
610 print medium
620 ink print head
630 scent print head
640 through-hole for ink print head
650 through-hole for scent print head

The invention claimed is:

1. Method for printing text characters and images on a print medium using a printer having scented ink reservoirs in communication with a print head, comprising:

using a processor to automatically detect an object in a digital image;

using the processor to automatically determine if one of the scents in the scented ink reservoirs corresponds to the detected object; and when a scent corresponds to the detected object, using the printer to automatically apply the determined scent from the corresponding scented ink reservoir to the print medium that is used for printing the digital image.

2. Method of claim 1, further comprising the step of selecting a region of the medium whereupon to apply the scent before the step of automatically applying the scent.

3. Method of claim 2, further comprising the steps of determining a location in the print of the object, and selecting the region of the medium whereupon to apply the scent in response to the step of determining the location.

4. Method of claim 2, wherein the selected region is any white space on the media.

5. Method of claim 2, wherein the selected region is any unprinted space on the media.

6. Method of claim 1, wherein the step of automatically applying the scent includes the step of selectively applying a heavy scent or a light scent.

7. In a printer comprising ink reservoirs in communication with a print head for printing text characters and images on a print medium, the improvement comprising:

a plurality of scented fluid reservoirs;

a plurality of nozzles each in communication with one of the scent reservoirs for applying at least one of the scented fluids onto the print medium; and a display for presenting to a printer user an option for deselecting an application of the scented fluid on the print medium.

8. The printer of claim 7, wherein each of the nozzles are controllable for applying said scented fluids onto the print medium.

9. The printer of claim 8, wherein each of the nozzles are controllable for applying said scented fluid onto a different region of the print medium.

10. The printer of claim 7, further comprising a carriage supporting the plurality of nozzles for selectively moving the plurality of nozzles to a predetermined position for applying the scented fluid on a predetermined location of the print medium.

11. In a printer comprising ink reservoirs in communication with a print head for printing text characters and images on a print medium, the improvement comprising:

a plurality of scented fluid reservoirs; and a plurality of nozzles each in communication with one of the scent reservoirs for applying at least one of the scented fluids onto the print medium;

electronic memory for storing a digital image; and a processor for determining whether the digital image contains an object for which an associated scent can be applied, and, if the processor determines that such an object is detected, the processor controls the nozzles to apply at least one of the scented fluids, and, if the processor determines that such an object is not detected, the processor does not control the nozzles to apply at least one of the scented fluids.

* * * * *